US006154924A

United States Patent [19]

Woo

[11] Patent Number: 6,154,924

[45] Date of Patent: Dec. 5, 2000

[54] DOOR CLOSER UNIT

[76] Inventor: Seng Yoon Woo, Daedu Third Twon A-402, 399-8, Dunjeon-ri, Pogok-mean, Yongin-city, Kyungki-do 449-810, Rep. of Korea

[21] Appl. No.: 09/171,970

[22] PCT Filed: Mar. 4, 1998

[86] PCT No.: PCT/KR98/00041

§ 371 Date: Oct. 29, 1998

§ 102(e) Date: Oct. 29, 1998

[87] PCT Pub. No.: WO98/39543

PCT Pub. Date: Sep. 11, 1998

[30] Foreign Application Priority Data

Mar. 4, 1997 [KR] Rep. of Korea ..... 97-7108

[51] Int. Cl.[7] ..... E05F 3/04

[52] U.S. Cl. ..... 16/62; 16/51; 16/65; 16/DIG. 17; 16/DIG. 9

[58] Field of Search ..... 16/62, 378, 54, 16/51, 49, 64, 79, DIG. 17, DIG. 9, 65

[56] References Cited

U.S. PATENT DOCUMENTS

| | | | |
|---|---|---|---|
| 4,358,870 | 11/1982 | Hong | 16/53 |
| 4,614,004 | 9/1986 | Oshida | 16/82 |
| 5,111,548 | 5/1992 | Ohshima . | |
| 5,152,029 | 10/1992 | Pai | 16/54 |
| 5,203,434 | 4/1993 | Teeter et al. | 188/70 R |
| 5,274,880 | 1/1994 | Ohshima . | |
| 5,495,639 | 3/1996 | Wartian | 16/79 |

FOREIGN PATENT DOCUMENTS

| | | |
|---|---|---|
| 0 016 445 A1 | 10/1980 | European Pat. Off. . |
| 36 29 250 A1 | 3/1988 | Germany . |
| 44 23 989 A1 | 2/1995 | Germany . |

*Primary Examiner*—Anthony Knight
*Assistant Examiner*—Mark Williams
*Attorney, Agent, or Firm*—McDermott, Will & Emery

[57] ABSTRACT

A door closer unit (100) including a cylindrical housing (10) with a partition (14) axially extending inside and having a first liquid path; a moving body (20) with a movable barrier (24) dividing the interior of the housing into first and second chambers, and a rotational shaft (21) having an upper end extending upward; a door return spring (30) applying a recovering force to the door in a direction opposite to the direction when the moving body's rotational shaft (21) or housing (10) rotates in one direction; a high-viscosity liquid filling in the housing; a control check valve for opening a second liquid path when the door is opened, and closing the second liquid path when the door is closed; a cover (40) rotatably supporting the rotational shaft (21) of the moving body (20) and sealing the upper portion of the housing (10); a speed controller (19) regulating the amount of the liquid when the door is opened or closed, thus controlling the speed of the door; and a door stopper (29) for stopping the door when the door reaches to a predetermined rotating angle including the door's initial position.

18 Claims, 13 Drawing Sheets

DOOR CLOSER UNIT

TECHNICAL FIELD

The present invention relates to a door closer unit. More particularly, it relates to a door closer unit of simple and compact structure employed for a revolving door operating in either one way or two ways, and applicable to various kinds of door supporting mechanisms, and generating a recovering force of a door with rotating motion only.

BACKGROUND ART

A door closer, generally provided to large-sized iron doors, is an automatic door closing system which allows a door to recover to its base position gradually, making use of a spring for closing at the time of opening the door.

Such door closers are divided into a rectilinear motion-type one using a piston and a rotating motion-type one using a rotating force, according to a power source for producing the accumulated recovering force at the opened door.

The above rectilinear motion-type door closer has a hydraulic cylinder installed in a body case of a laterally long shape, and a piston telescopically inserted into the hydraulic cylinder through a return spring, a rack engraved on one sidewall of the piston, and a pinion rotatably supported to a pinion shaft to be engaged with the rack at one side of the cylinder.

According to the door closer, the body case is clamped at the upper portion of a door, and the pinion shaft is securely hinged on a doorframe via a pair of hinge arms. once the door is opened, the pinion shaft rotates via the hinge arms, and its rotating force moves the piston through the rack, thus compressing the spring received in the cylinder. If loosing hold of the door, the accumulated recovering force of the return spring is controlled by the fluid and the piston returns at a predetermined speed so the pinion shaft gradually turns and the door is closed at a constant speed.

In such a door closer the hydraulic piston is rectilinearly driven by the rack and the pinion, and the door closer's overall size becomes large. It is supported onto the doorframe by a pair of the hinge arms, thus being restricted in installation. There is also much noise from several connecting parts of the hinge arms and door closer body when using the door closer for a long period of time. In the door closer the thrust load is applied to the pinion shaft, and the bearings for rotatably supporting the pinion shaft are relatively quickly worn due to the thrust load of the pinion shaft. When power is transmitted to the piston through the rack of one side, a bending load is applied to the piston in its moving direction. Thus, the piston and the cylinder are irregularly worn out.

In order to solve the above problems, a rotating motion-type door closer has been disclosed in U.S. Pat. No. 5,111,548.

The rotating motion-type door closer includes a damper having an arm fixed to a door, a rotational shaft supported at the center of the body case and formed in the body case, a pair of chambers filled with high-viscosity liquids communicating via passages of the rotational shaft, a pair of rotary blades respectively having passages with check valves on the rotational shaft and internally mounted in the pair of chambers; a stationary plate fixed to the body case; an intermediate plate engaged with the rotational shaft as to be rotatable at a predetermined angle against the return spring by the rotational shaft; a movable plate engaged with a sub case as to be rotatable together with the sub case; a plurality of rotary connectors each movably engaged with through holes formed on the intermediate plate; and an angle clutch regulating the rotation of the intermediate plate by a predetermined angle.

The adjusting arm on the sub case, as described in U.S. Pat. No. 5,274,880, has the other end hinged on the doorframe, and the inner cylinder is integrally formed with the outer cylinder coupled with the sub case, and is securely hinged on the door via the arm extending from the outer cylinder.

The conventional door closer has a pair of chambers divided by a pair of projections, and the rotation angle of the sub case is limited to 90° or less. In addition, the return spring is supported between the inner and outer cylinder, thus increasing the overall size of the door closer.

If the rotation angle of the door is enlarged to 180, the door closer must be supported between the door and the doorframe via a pair of hinge arms with a hinge member due to the small rotation angle of the sub case. Therefore, it is hard to apply the conventional door closer to a two-way revolving door having no hinge arm, and reducing the overall size and weight of the door closer is not easy.

A plurality of components interconnect, which complicates the overall structure, and it is difficult to assemble them into a door closer and the assembling steps are increased to thereby lower the production yield. This also increases the overall production costs and causes frequent breakdowns.

The conventional door closer is provided to the door with a pair of the hinge arms protruding to the outside, which deteriorates the outer appearance of the door and increases the load of the door acting on the door hinge, thus preventing the door from opening smoothly, and making it difficult to mount the door closer at the door.

DISCLOSURE OF INVENTION

It is a first object of the present invention to provide a door closer unit of simple structure which is applicable to a one-way or two-way revolving door and various door supporting mechanisms and generating a door's recovering force with the rotating motion only.

It is a second object of the present invention to provide a door closer unit which is applicable to large-sized gates of buildings, small-sized doors of various household electric appliances, doors of furniture, etc.

It is a third object of the present invention to provide a door closer unit which ensures the shock absorption by the strong wind or something.

It is a fourth object of the present invention to provide a door closer unit which can return to a predetermined initial state and stop at the predetermined position.

It is a fifth object of the present invention to provide a door closer unit which can employ a rotational shaft immovable & housing revolving manner as well as a housing immovable & rotational shaft revolving manner, and allows 270° for the maximum rotation angle of the rotational shaft or housing.

It is a sixth object of the present invention to provide a cylindrical door closer unit which lowers the production costs by forming a hinge assembly integrally therewith, and makes its outer appearance good.

It is a seventh object of the present invention to provide a hinge assembly which provides an automatic door closing mechanism and makes a door stop at a predetermined angle.

In order to realize the above objects, the present invention provides a door closer unit including a cylindrical housing with a partition axially extending from on one side of its inner surface and having a first liquid path and a tiered shaft receiving nest on the center of its inner bottom; a moving body with a movable barrier having an outer surface in a sliding contact with the partition, protruding from its one side to be in a sliding contact with the inner surface of the housing, and dividing the interior of the housing into first and second chambers, and a rotational shaft having a lower end rotatably housed in the shaft receiving nest and an upper end extending upward; a rotating body return spring disposed between the shaft receiving nest and the moving body's inner groove, and, when one of the moving body's rotational shaft and housing is fixed to a doorframe and the other is fixed to the door and rotates in one direction, applying a recovering force to a rotating body in a direction opposite to the direction; a high-viscosity liquid filling in the housing; a first check valve disposed on one side of the movable barrier, opening a second liquid path allowing the first and second chambers to communicate with each other when the rotating body rotates in one direction, and closing the second liquid path when the rotating body turns in a direction opposite to the direction; a cover rotatably supporting the rotational shaft of the moving body and sealing the upper portion of the housing; and a speed controller regulating the amount of the liquid flowing from one chamber of high pressure to the other chamber of low pressure via the first liquid path of the housing when the rotating body is turned, thus controlling the speed of the rotating body.

The door is opened if the rotating body is turned in one way, and the door is closed if the rotating body is turned in the opposite direction by the recovering force from the return spring. When opening the door, the liquid flows through the first and second liquid paths whereby the rotating body is turned at high speed, and when closing the door, the liquid flowing through the first liquid path only whereby the rotating body is turned at low speed.

The inventive unit further includes a projecting pin elastically provided to one of the movable barrier's upper section, lower section or outer surface that contacts the inner circumference of the housing; and at least one stop hole disposed on a track made on a fixed body by the rotating body to stop the rotating door when the projecting pin mates with the stop hole. The moving body has an initial position defined on either first and second points near both sides of the partition or a third point between the first and second points, and the stop hole is formed on the initial position. At least one stop hole is formed on a door opening position. The inventive unit further includes a shock absorber inserted into the housing for absorbing an impact created when the movable barrier collides with the partition by an external force applied to the rotating body.

The first check valve includes at least one liquid path for allowing the first and second chambers to communicate with each other; and a flexible valve plate formed on one side of the movable barrier opposite to the partition for shutting off the liquid path. While the rotational shaft has been turned by a given angle in the same direction as the rotating direction of the rotating body in the initial position of the moving body, the rotational shaft is fixed to a doorframe supporting body, and the residual stress remains even when the opened door returns to an initially set position.

The door closer unit further includes a second check valve disposed on the other side of the movable barrier, opening the third liquid path when the rotational shaft is turned in the opposite direction, and closing the third liquid path when the rotational shaft is turned in one direction; and an initial position setting means having first and second magnets of different polarity each disposed on one side wall of the housing opposite to the partition and on a corresponding point of the movable barrier of the moving body. The door is a two-way revolving door. The housing of the door closer unit is fixedly embedded in a floor, and the rotational shaft constitutes a lower hinge shaft of the door. The housing of the door closer unit is fixedly embedded in the door's upper end, and the rotational shaft constitutes an upper hinge shaft of the door. The housing is fixedly disposed on the doorframe's uppermost portion, and the rotational shaft is disposed on the upper end of the door through the door supporting body, thus constituting a hinge shaft of the door.

The door closer unit further includes a door supporting body having one end secured to the cover and the other end fixedly disposed on the upper end of the door; and a doorframe supporting body having one end secured to the rotational shaft of the moving body and the other end fixedly disposed on a point corresponding to the door supporting body of the doorframe. The door closer unit is used as an upper hinge.

The door closer unit further includes a bracket for securing the housing to the upper end of the door; and a first hinge arm having one end hinged upon the rotational shaft. The second hinge arm having one end joined to the other end of the first hinge arm via a hinge assembly, and the other end hinged upon the upper end of the doorframe. The upper end of the housing is integrally formed with a lower end portion of a doorframe fixing plate of a hinge assembly by which the door is joined to the doorframe, and the rotational shaft is fixed to a connecting portion extending from a door fixing plate of the hinge assembly.

According to another aspect of the present invention, a door closer unit includes a cylindrical housing with a partition axially extending from on one side of its inner surface and having a first liquid path and a tiered shaft receiving nest on the center of its inner bottom; a moving body with a movable barrier having an outer surface in a sliding contact with the partition, protruding from its one side to be in a sliding contact with the inner surface of the housing, and dividing the interior of the housing into first and second chambers, and a rotational shaft having a lower end rotatably housed in the shaft receiving nest and an upper end extending upward; a door return spring disposed between the shaft receiving nest and the moving body's inner groove, and, when one of the moving body's rotational shaft and housing is fixed to a doorframe and the other is fixed to the door and rotates in one direction, applying a recovering force to the door in a direction opposite to the direction; a high-viscosity liquid filling in the housing; a control check valve disposed on one side of the movable barrier, opening a second liquid path allowing the first and second chambers to communicate with each other when the door is opened, and closing the second liquid path when the door is closed; a cover rotatably supporting the rotational shaft of the moving body and sealing the upper portion of the housing; a speed controller regulating the amount of the liquid flowing from one chamber of high pressure to the other chamber of low pressure via the first liquid path of the housing when the door is opened or closed, thus controlling the speed of the door; and a door stopper for stopping the door when the door reaches to a predetermined rotating angle including the door's initial position.

The door is automatically closed by the recovering force of the door return spring as the door is opened, and the liquid flows through the first and second liquid paths at high speed if the door is opened. The liquid flows through the first liquid path only at low speed if the door is closed. The control valve is a two-way check valve, and the door closer unit is used as a hinge assembly of a two-way revolving door.

The door closer unit is mounted on the door and the doorframe in one of a housing immovable & rotational shaft revolving manner and a rotational shaft immovable & housing revolving manner. The door return spring is one of a coil spring, a plate spring, or a torsion bar.

The hinge assembly with an automatic door closing mechanism includes housing having a doorframe fixing plate secured to a doorframe on one side of its outer surface of cylindrical shape; a door closer body installed in the housing for automatic door closing and having a plurality of through holes radially passing through the core of a rotational shaft extending to the outside; a door fixing plate having one end secured to the door, and connecting portion having a plurality of through holes radially, formed on the other end extending from the one end and passing through the core of the rotational shaft, and joined to the outer surface of the rotational shaft; and a pin for coupling the connecting portion to the rotational shaft while the rotational shaft is turned in a predetermined direction to apply a residual stress to the rotational shaft.

BRIEF DESCRIPTION OF DRAWINGS

A more complete appreciation of this invention, and many of the attendant of advantages thereof, will be readily apparent as the same becomes better understood by reference to the following detailed description when considered in conjunction with the accompanying drawings in which like reference symbols indicate the same or similar components, wherein.

BEST MODE FOR CARRYING OUT THE INVENTION

Figure 1:
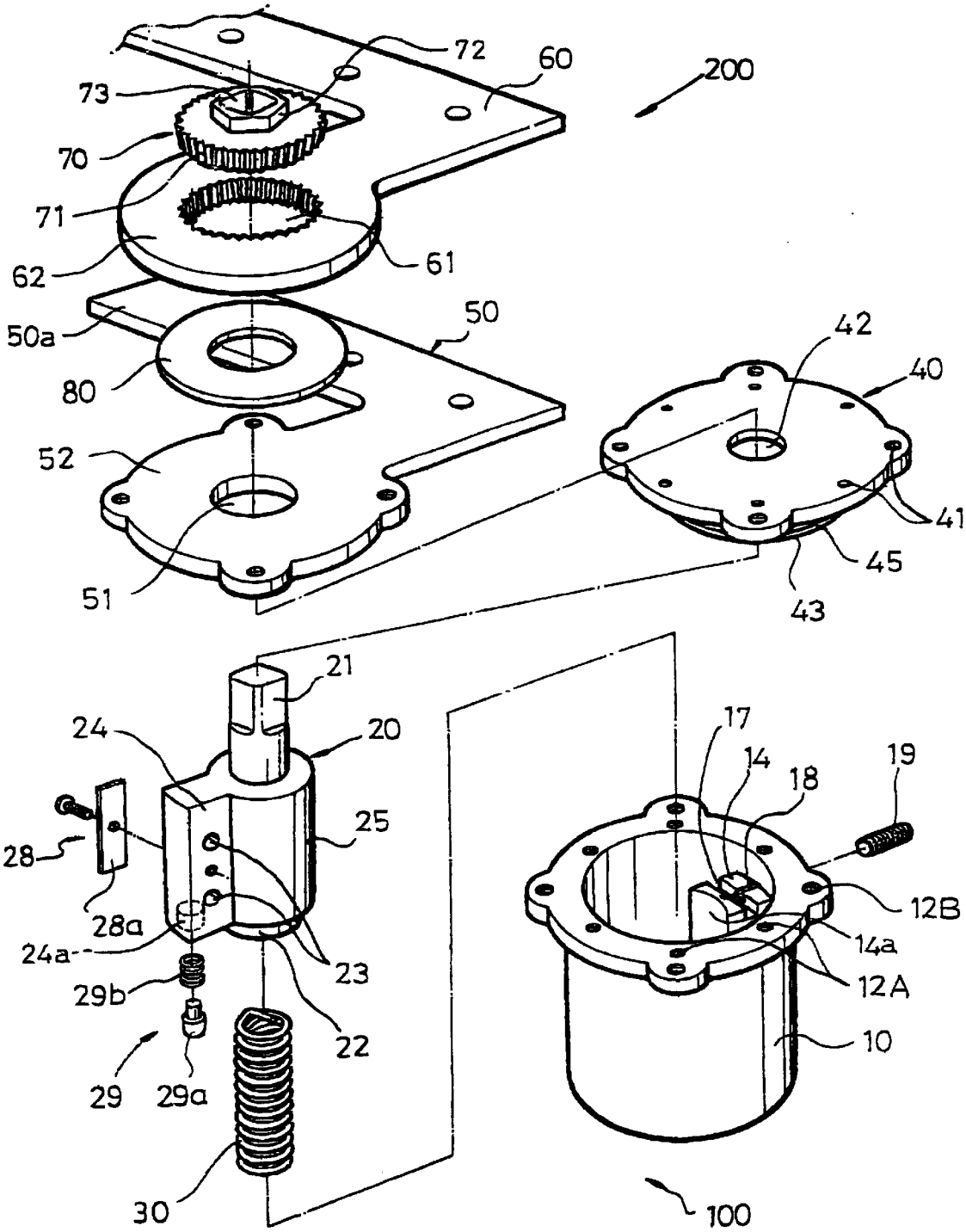
FIG. 1 is an exploded-perspective view of a door closer unit in accordance with a first preferred embodiment of the present invention.

Preferred embodiments will be now described with reference to the accompanying drawings.

Referring now to FIGS. 1 to 4, a door closer unit 100 in accordance with a first preferred embodiment of the present invention includes a single cylindrical housing 10 holding a high-viscosity oil 11 and having an open upper portion. A plurality of connection holes and coupling holes 12A and 12B are formed at the housing 10's upper rim, and a partition 14 extends protruding from on one side of the housing 10's interior. The housing 10 has a tiered shaft receiving nest 15 on the center of its inner bottom, and a cross-shaped support member 16.

Figure 2:
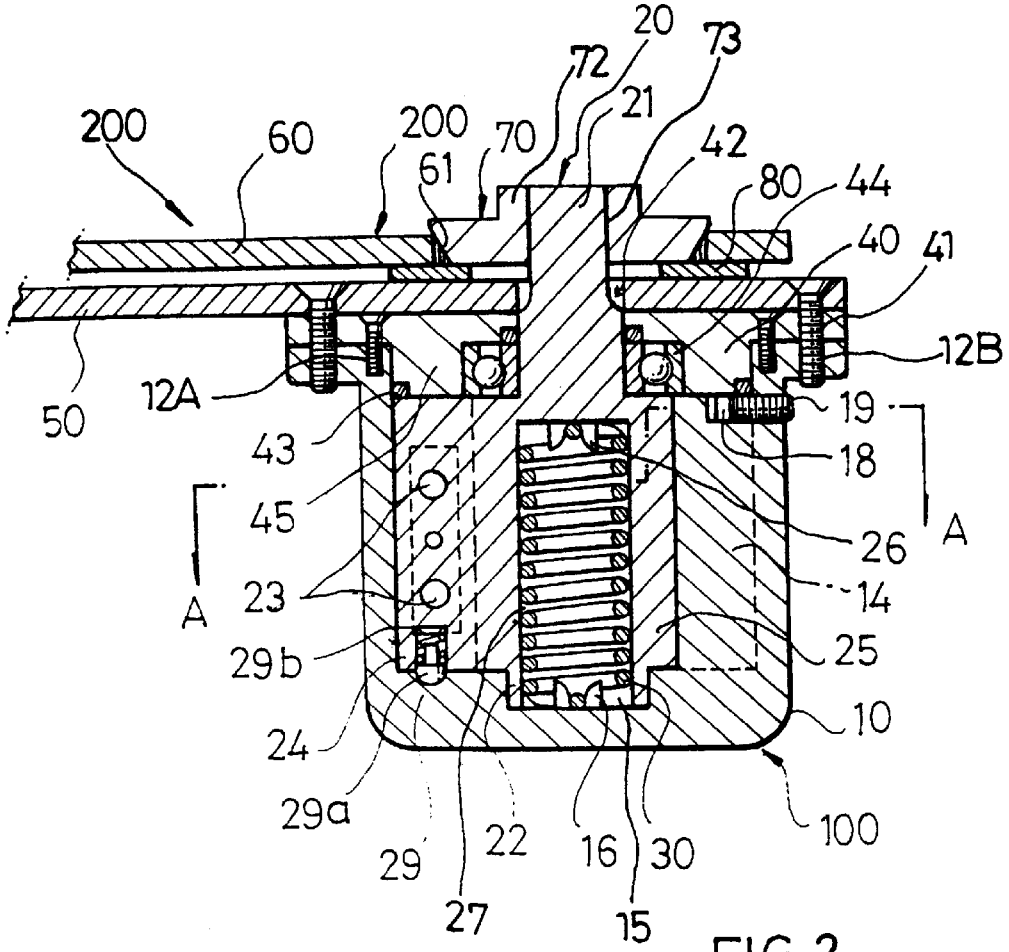
FIG. 2 is a side-sectional view of a coupling structure of the door closer unit in accordance with the first preferred embodiment of the present invention.
Figure 3:
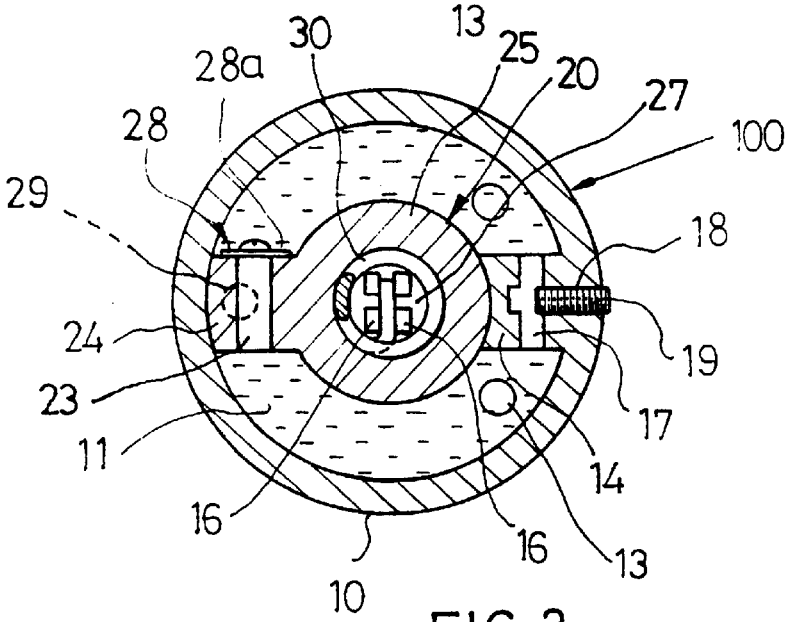
FIG. 3 is a sectional view as taken along line A—A of FIG. 2.
Figure 4:
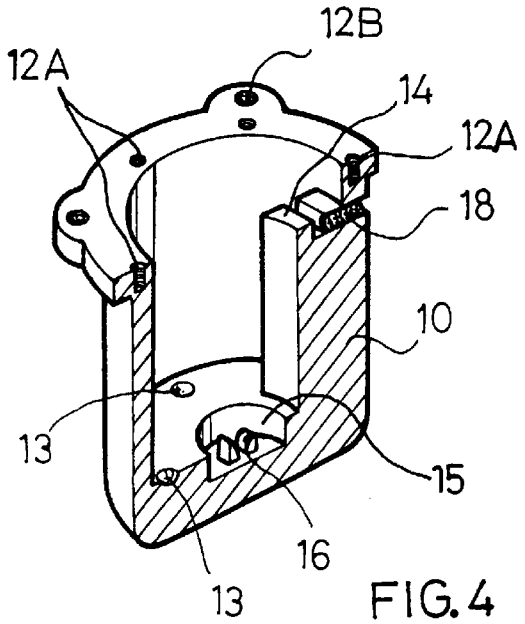
FIG. 4 is a front-sectional view of the door closer unit's housing in accordance with the first preferred embodiment of the present invention.

In the housing 10 there is a moving body 20 having an inserting portion 22 protruding from its lower end to be fit in the nest 15, a median portion 25 whose outer surface is in a sliding contact with a front curved surface 14*a* of the partition 14, and a movable barrier 24 protruding from its one side to be in a sliding contact with the inner surface of the housing 10. Upper and lower liquid paths 23 are formed on the movable barrier 24, and inside of the moving body 20, is a hole 27 having an open lower end and an upper end having a locking member 26, as shown in FIG. 2. A rotational shaft 21 having a cylindrical portion and portions of e.g. rectangular shape, vertically extends from the upper section of the moving body 20.

A return spring 30 has an upper end securely connected to the locking member 26 of the hole 27, and a lower end of the support member 16 of the nest 15 in the housing 10, and is twisted upon rotation of the moving body 20 to produce a recovering force.

In case of a left-opening door the return spring 30 is wound counterclockwise, and for a right-opening door, it is wound clockwise. Return springs each wound clockwise and counterclockwise are used for a two-way opening door. A torsion bar or plate spring with the one-way or two-way torsion recovering force may be used instead of the return spring 30.

There is a cover 40 which is the same as the upper section of the housing in shape for sealing the upper section of the housing. A sealing member 43 is provided to an outer circumference of the cover 40's lower section corresponding to the opening of the housing 10, and a fitting extension 45 with a bearing 44 extends downward from the cover's inner circumference to the cylindrical portion of the rotational shaft 21. A plurality of holes 41 open into the rim of the cover 40 corresponding to the housing 10's connecting and coupling holes 12A and 12B, and a shaft through hole 42 is formed at the middle of the the rotational shaft 21 of the moving body 40, through which the rotational shaft passes.

The partition 14 of the housing 10 has a through path 17 on its upper portion, and a female screw hole 18 for vertically receiving a hydraulic tube 19 from the outside, at the middle of the through path 17. Opening or closing the through path 17 depends on the inserting degree of the hydraulic tube 19, and the hydraulic pressure, produced from the high viscosity oil 11 of the housing 10, is selectively controlled by the rotation of the moving body 20. A plate 28*a* for sealing one side of the upper and lower liquid paths 23 is secured to the movable barrier 24 of the moving body 20 via a screw, thus constituting a check valve 28. When the door D is opened, i.e. the housing 10 rotates clockwise or the rotational shaft 21/moving body 20 rotates counterclockwise, the check valve 28 lets the high-viscosity oil 11 push the plate 28*a* to open the liquid paths 23 and reduce the hydraulic pressure so that the door D is easily opened. When the door D is closed, the high-viscosity oil closes the liquid paths 23 with the plate 28*a* to increase the hydraulic pressure acting on the door D, thus closing the door D smoothly and slowly.

In the first preferred embodiment, as shown in FIGS. 1 and 2, there are a pin receiving hole 24*a*, a brake 29 consisting of a pin 29*a* with a semi-circular or curved lower end and a spring 29*b* at the lower end of the movable barrier 24, and a plurality of stop holes 13 corresponding to the pin 29*a* on the housing lo's inner bottom so as to stop the rotating door D at a predetermined angle.

A fixing assembly 200 for mounting the door closer unit 100 of the first preferred embodiment on the door D includes a door supporting body 50 consisting of a supporting portion 50*a* fixed onto one side of the door D's upper end and a connecting portion 52 extending at a right angle to the support portion 50*a*, and screwed to the cover 40 via four screws. A doughnut-shaped washer 80 is joined to the upper section of the door supporting body 50 to reduce friction, and a doorframe supporting body 60 which is substantially the same as the door supporting body 50 in shape and has a supporting portion whose one end is securely fixed to a doorframe D1 and an extending portion 62 with a hole 61 is coupled to the top of the washer 80. A plurality of tapered convex and concave portions are continuously formed at the inner circumference of the hole 61 to absorb the coupling deviation due to a position error between the door D and the doorframe D1, and a wedge 70 having a plurality of cogs 71 on its outer circumference corresponding to the inner circumference of the hole 61, and a hexagonal coupling member 72 formed to mate with a tool such as a wrench and having a square through hole 73 at its center, in which the rotational shaft 21 of the moving body 20 fits.

Figure 8:
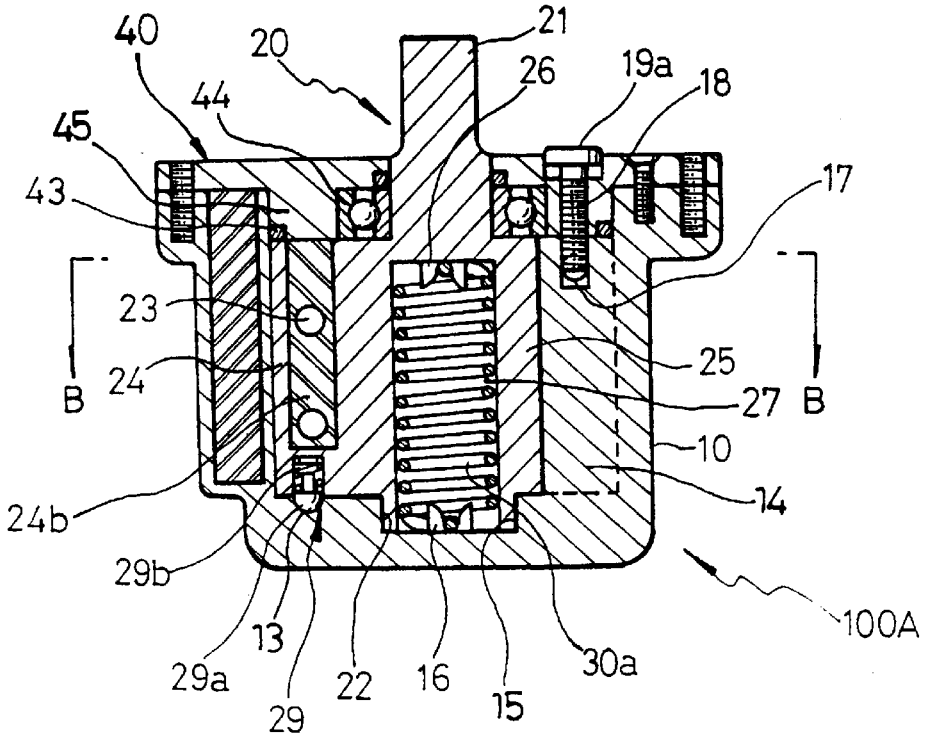
FIG. 8 is a side-sectional view of a door closer unit with an initial position return mechanism in accordance with a third preferred embodiment of the present invention.
Figure 9:
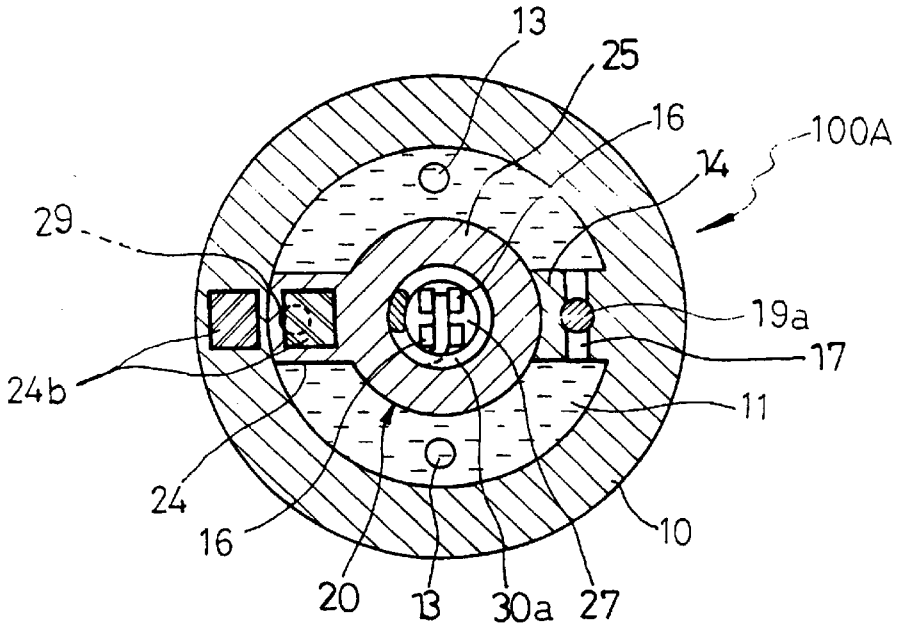
FIG. 9 is a sectional view as taken along line B—B of FIG. 8.
Figure 10:
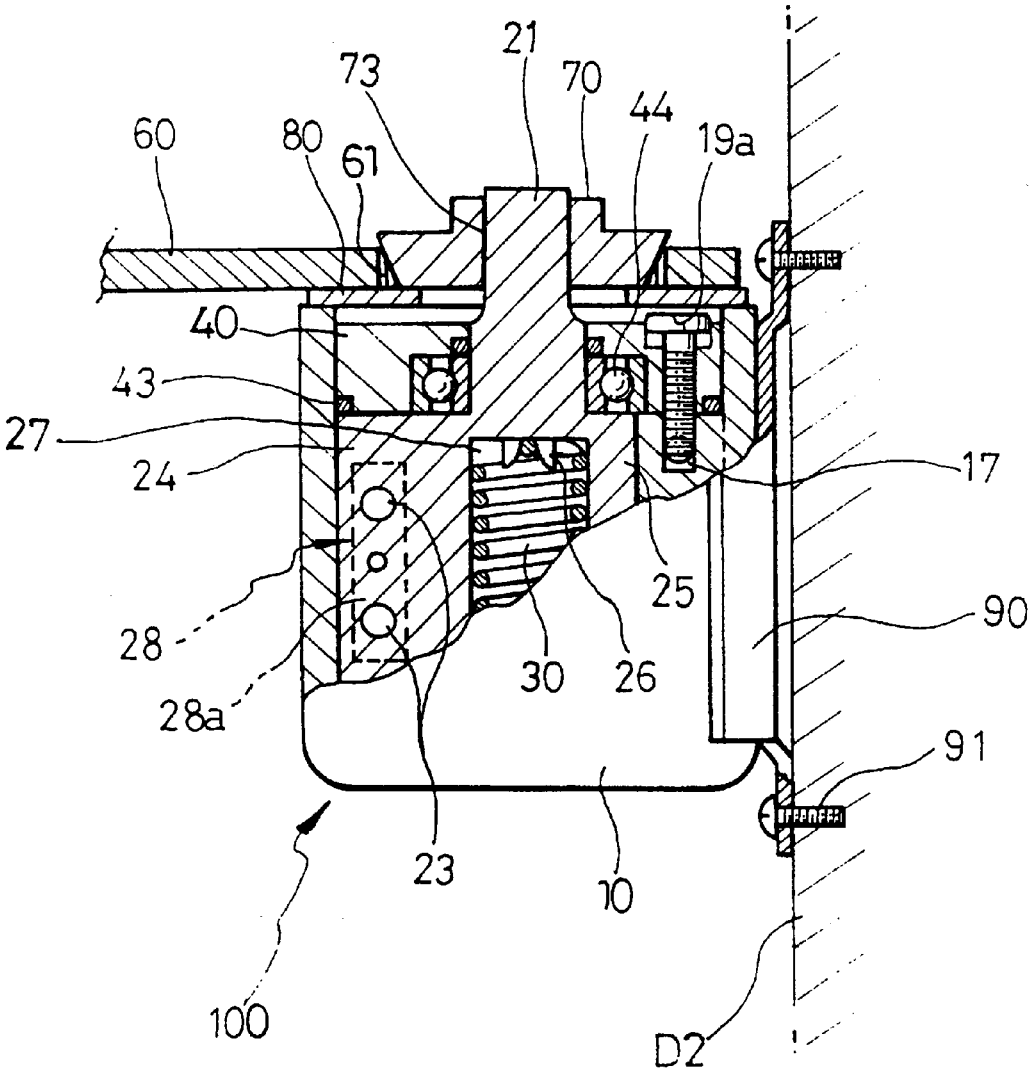
FIG. 10 is a partially-cutout sectional view of a clamping structure of a door closer unit attached to a doorframe.

The fixing assembly 200 shown in FIGS. 1 to 11 is for a door closer unit employing a rotational shaft immovable & housing revolving manner. A housing immovable & rotational shaft revolving manner, as shown in FIGS. 10 to 11*b*, can be employed for the door closer unit 100 of the first preferred embodiment of the present invention.

The operation of the door closer unit 100 in accordance with the first preferred embodiment of the present invention will be described referring to FIGS. 5 to 6.

First, the following description concerns the case where the door closer unit 100, using the housing immovable & rotational shaft revolving manner, is mounted on the door D, and the moving body 20 rotates clockwise as the door D is opened.

As the high-viscosity oil 11 of a second chamber CH2, placed between the movable barrier 24 and the partition 14, flows into a first chamber CH1 via the upper and lower liquid paths 23, the check valve 28 is opened so that the high-viscosity oil 11 is introduced to the first chamber CH1 of low pressure from the second chamber CH2 of high pressure through the liquid paths 23 and the through path 17. Thus, a user can open the door D without much trouble.

Figure 5:
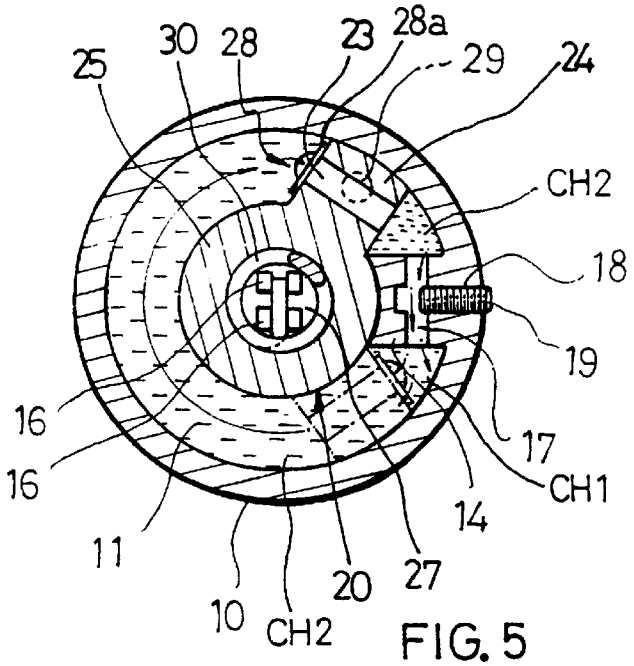
FIG. 5 is a sectional view for describing the operation of the door closer unit.

In the first preferred embodiment, as shown in FIG. 5, the rotation angle of the movable barrier 24 is about 270°, and there is no need to use an extra hinge assembly to increase the rotation angle.

Figure 6:
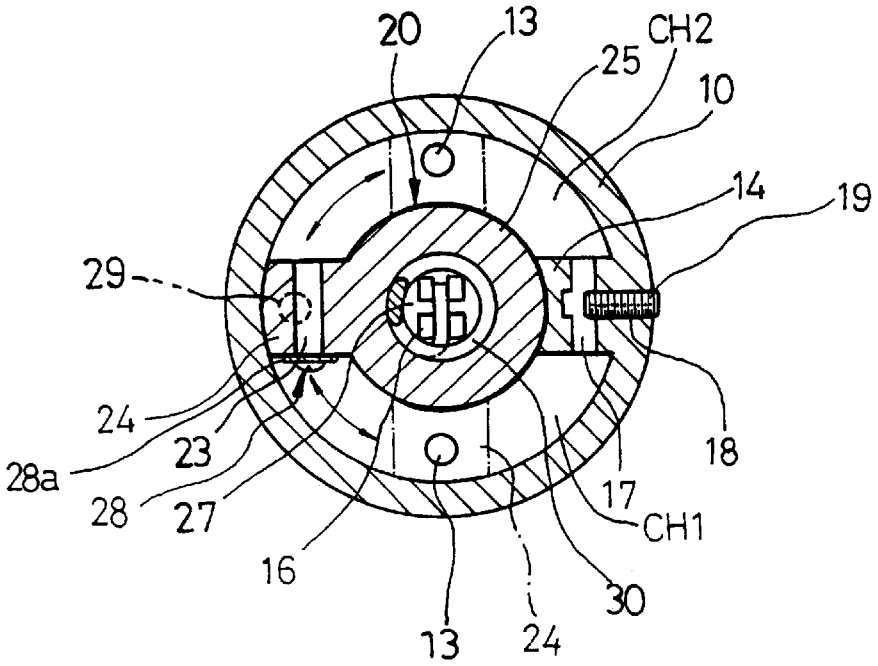
FIG. 6 is a plan view in use for describing a first positioning mechanism of the door closer unit in accordance with the first preferred embodiment of the present invention.

The opened door D can be locked at a predetermined door opening angle, as shown in FIGS. 5 and 6. That is, as the pin 29*a* of the brake 29, provided to the lower end of the movable barrier 24, reaches one or two stop holes 13, it fits in one of the stop holes 13 by the reaction of the spring 29*b*, thus stopping the rotation of the door D. The two stop holes 13 may be located by a predetermined angle or the same angle according to the circumstances.

Preferably, the stop holes 13 are formed at about 1800 , the maximum door opening angle for doors of a hall-style apartment.

If the door closer unit is mounted on a door of a general apartment, it is preferable that the stop holes 13 are formed at about 120 to 130°, the maximum door opening angle. In a refrigerator whose door opening angle is decided according to the size of an article or the number of articles to be taken out, it is preferable to locate several stop holes 13 by a predetermined angle, which prevents loss of cool air inside the refrigerator and allows a user to easily and rapidly take out a desired article therefrom.

When locating the stop holes 13 at an initial position of the door D, as the door D is closed by the recovering force and returns to the initial position, it automatically stops there, which may be useful for a floor hinge type one-way or two-way revolving door.

In the present invention, the door D may be completely compressed upon the doorframe D1's threshold during the automatic closing operation of the door D, thus pressing an air tight weather strip provided to the threshold. When mounting the door closer unit 100 on the door D, the rotating shaft 21 is secured to the doorframe supporting body 60 via the wedge 70 while the recovering force of the return spring 30 equals zero and the rotational shaft 21 is rotated by a predetermined angle in a direction contrary to the door opening direction. When the rotational shaft 21 rotates by a predetermined angle in a direction contrary to the door opening direction, the residual stress remains on the return spring 30 even if the door D is closed and returns to the initial position. This causes the door D to keep on rotating by the residual recovering force created by the residual stress so that the door D is in a close contact with the doorframe D1.

The brake 29 and stop holes 13 for stopping the door at the predetermined angle may be either formed on the upper section of the movable barrier 24 and the lower portion of the cover 40, respectively, or oppositely formed on each side surface of the movable barrier 24 contacting the housing 10.

For releasing the locking state of the door D, as an external force is applied to the door D, the pin 29*a* that has been received in one of the stop holes 13 is removed therefrom so that the door D can be moved. For opening the door D, the return spring 30 whose upper end is securely connected to the locking member 26 of the hole 27, and the lower end of the support member 16 of the nest 15 in the housing 10, is twisted upon rotation of the moving body 20 to produce the accumulated residual stress. As a result, the recovering force is generated for returning the door D, opened by the accumulated residual stress, to its original state.

As a user releases his or her hold of the door D for closing the door D, the door D rotates counterclockwise by the recovering force of the return spring 30. In that case, the check valve 28 of the movable barrier 24 becomes shut off, the oil 11 flows to the second chamber CH2 from the first chamber CH1, thus closing the door D slowly.

The operating speed of the moving body 20 of the door closer unit 100 at the time of opening or closing the door D, can be controlled by regulating the amount of the oil flowing via the through path 17 according to the inserting degree of the hydraulic tube 19. A silicon oil is usually used as the oil 11, and the inserting degree of the hydraulic tube 19 is determined considering the viscosity of the oil and the temperature variation with seasons.

Figure 7:
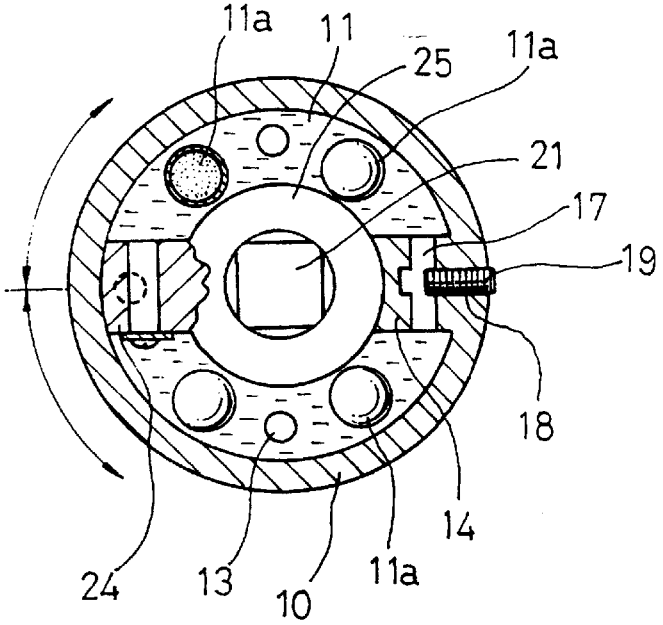
FIG. 7 is a plan-sectional view of a door closer unit's housing with a shock-absorbing mechanism in accordance with a second preferred embodiment of the present invention.

FIG. 7 depicts a door closer unit 100 with the shock-absorbing mechanism in accordance with a second preferred embodiment of the present invention.

In this embodiment, there are a plurality of air balls 11*a* filled with the air or a given gas inside of a ball made of an elastic rubber with the oil 11 in the housing 10 of the door closer unit 100. When the strong wind or external force abruptly acts on the door D, the oil 11 is moved from one chamber of high pressure to the other chamber of low pressure via the liquid paths 23 and the through path 17, and the movable barrier 24 then rotates clockwise/counterclockwise, thus causing damage to the door closer unit 100.

The air balls 11*a*, seated within the chamber which is in the rotating direction, serve as a shock absorber using a kind of an air bag, and begins to deflate prior to the partition 14's restricting the rotation of the movable barrier 24, thus absorbing the outer shock. When the movable barrier 24 returns to its original state, the air balls 11*a* are also restored to their original state to assist the restoration of the return spring 30 and absorb minute vibrations.

FIG. 8 is a side-sectional view of a door closer unit 100A with the initial position return mechanism in accordance with a third preferred embodiment of the present invention, and FIG. 9 is a sectional view as taken along line B—B of FIG. 8.

The door closer unit 100A of the third preferred embodiment has magnetic bodies 24*b* and 24*c* of different polarity that are each embedded in one side of the housing 10, e.g. a point opposite to the partition 14 and the movable barrier 24. The magnetic body 24*b*, embedded in the movable barrier 24 of the moving body 20, has a hole coaxial with a pair of the liquid paths 23 not to interrupt the oil flow.

In the case where the magnetic bodies 24*b* and 24*c* are each disposed on predetermined positions of the respective movable barrier 24 and the housing 10, the movable barrier 24 that is on that position on fails to rotate by the magnetic force.

The door closer unit 100A with the function of returning the movable barrier 24 to its initial position or stopping the barrier 24, as shown in FIG. 9, is useful for a two-way revolving door. The floor hinge type door D which is illustrated in FIGS. 11*e* and 11*f* performs two-way rotation, and the middle point of the rotation becomes the initial position of the door D.

When using the door closer unit 100A in both ways, either a double spring 30*a*, consisting of a clockwise spring and a counterclockwise spring, or a torsion bar with the two-way torsion recovering force may be used as the return spring. If the movable barrier 24 is in the initial position, the recovering force of the double spring 30*a* or torsion bar is set to zero. According to the third preferred embodiment of the present invention, unlike the first and second preferred embodiments of the present invention, the door D can be opened and closed in two ways without the plate 28*a* formed on one side of the movable barrier 24 constituting the check valve 28. The diameter of the respective liquid paths 23 is different from that of the respective first and second preferred embodiments.

The door closer unit includes a two-way check valve assembly having a pair of check valves, respectively installed on both sides of the movable barrier 24, and opened with a predetermined pressure and closed with the predetermined pressure or less. When the door D that was opened in the same way as that of the first preferred embodiment is closed, it is slowly closed at its initial position. That is, as the recovering force of the double spring 30*a*, a return elastic body, amounts to the minimum point, the pressure to the oil 11 is decreased. This causes both the check valves to be closed, and the pressed oil flows via the through path 17 only to thereby reduce the operating speed of the movable barrier 24.

In the first and second preferred embodiments of the present invention, the hydraulic tube 19 for controlling the door closing speed is laterally provided to one side surface of the housing 10, and, in the doorframe-fixing type for a floor hinge type door shown in the third preferred embodiment or FIG. 10, the tube 19 is disposed to restrict the through path 17 vertically from the upper portion of the housing 10, even if the side surface of the housing 10 is embedded in a floor 140 or door, a hydraulic tube 19*a* can be easily controlled through its upper portion exposed to the outside. The hydraulic tube 19*a* may be employed in the first and second preferred embodiments of the present invention, if necessary.

The following description relates to application of the door closer unit 100/100A in accordance with the first to third preferred embodiments of the present invention.

The door closer unit 100 for a one-way opening door may employ a rotational shaft immovable & housing revolving manner by respectively connecting the rotational shaft 21 and the housing 10 to the doorframe supporting body 60 and the door supporting body 50, as shown in FIG. 1.

The supporting portion of the doorframe supporting body 60 is fixed to the doorframe D1's upper portion, and that of the door supporting body 50 is fixed to the door D's upper portion. When opening or closing the door D, the housing 10 of the door closer unit 100 rotates about the rotational shaft 21. The door closer unit supports the door D rotatably, and may be mounted on the door D without any hinge member.

Figure 12:
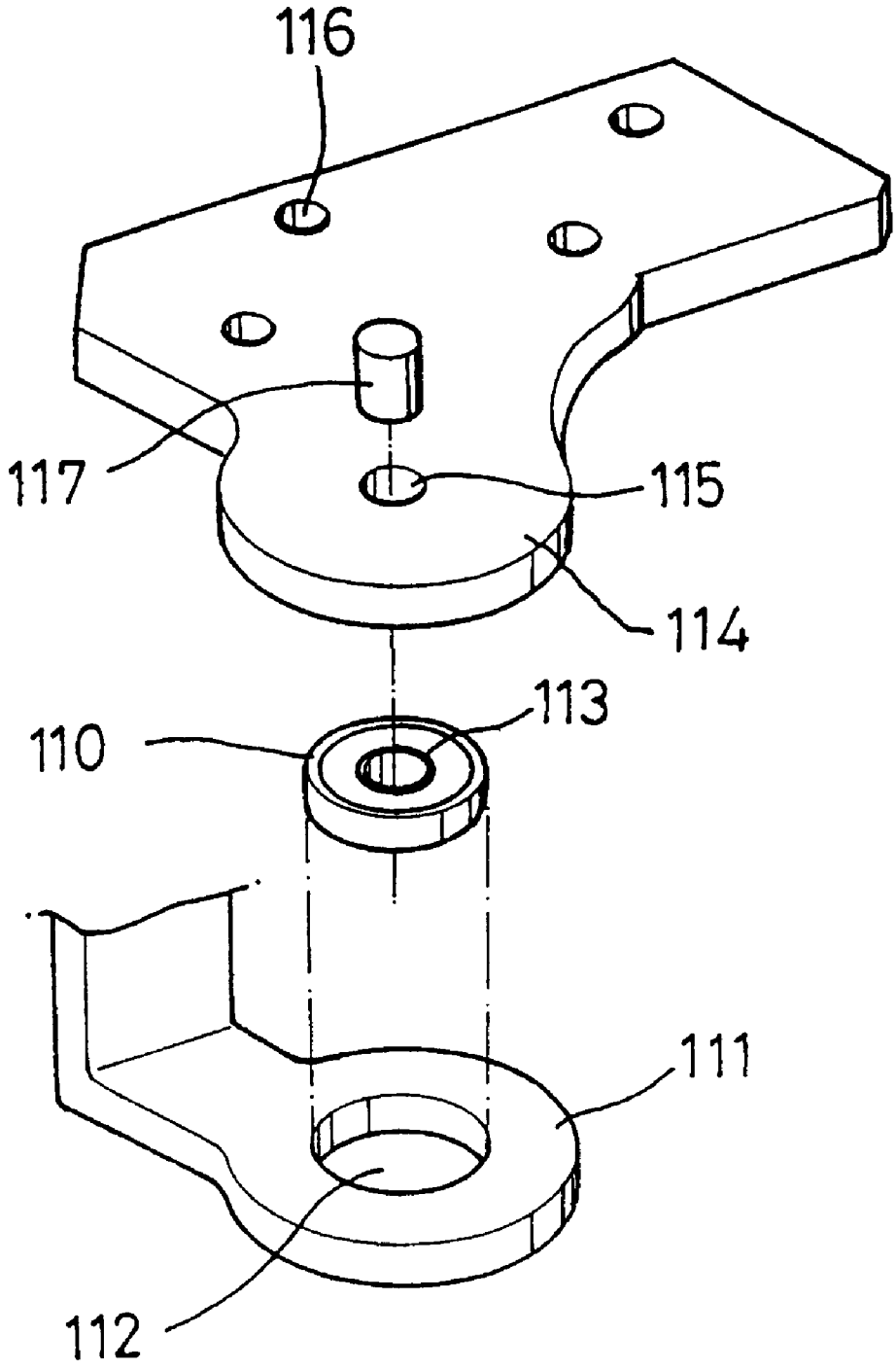
FIG. 12 is an exploded-perspective view of a lower hinge of FIG. 11*a;*

The present invention has a very simple and compact structure compared to the conventional door closer mount mechanism having a pair of hinge arms and a pair of hinges for connecting them to the door and doorframe. In a hinge assembly D2 of FIG. 11*a* for rotatably supporting the door D's lower side portion, as shown in FIG. 12, under the bearing 110 is disposed a doorframe supporting body 111 with one end secured to the doorframe D1 and a bearing receiving groove 112 at the other end. On the bearing 110 is disposed a door supporting body 114 having one end secured to the door D and a pin coupling hole 115 at the other end. Under this condition, the hinge pin 117 is downwardly inserted into the pin coupling hole 115 and bearing's through hole 113 to hold the bearing 110 and the body 114 together, thus constituting the hinge assembly D2. Reference numeral 116 denotes a screw hole.

Figure 11A:
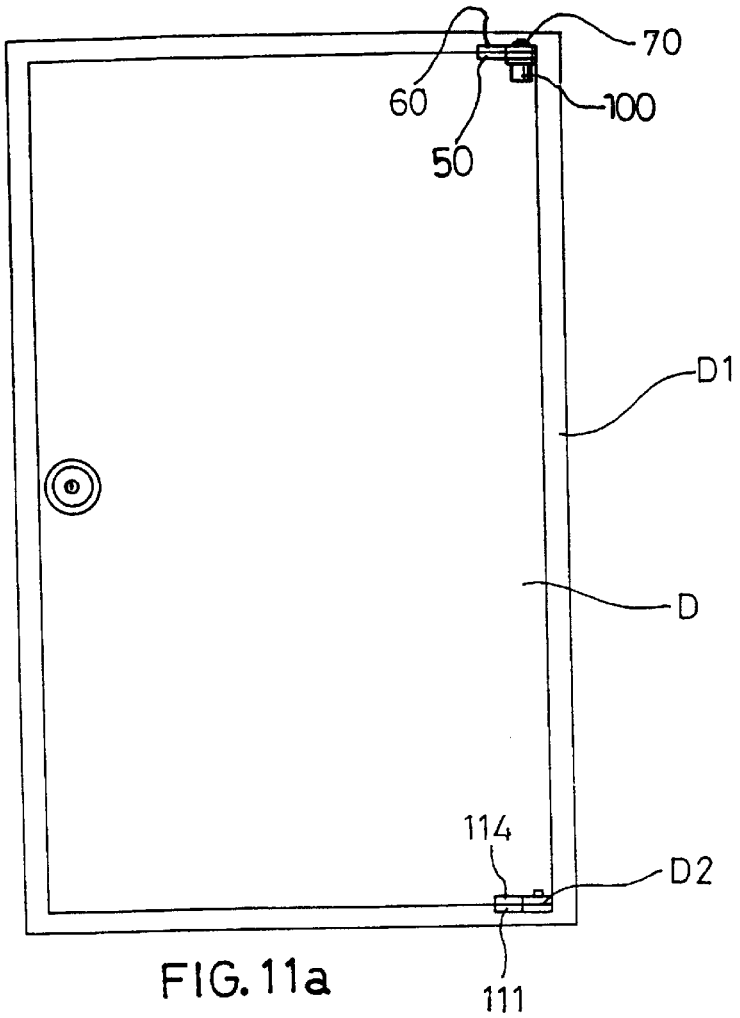
FIG. 11*a* is a front view of the inventive door closer unit connected to a door and a doorframe via a door supporting body and a doorframe supporting body by the use of a hinge member.
Figure 11B:
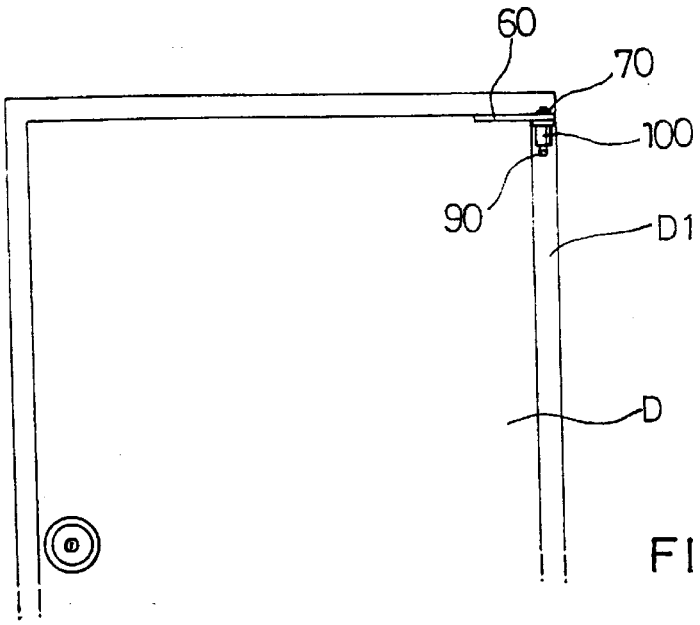
FIG. 11*b* is a front view of the inventive door closer unit provided to the doorframe and connected with the door by the doorframe supporting body.

A door closer unit of housing revolving & rotational shaft immovable manner is shown in FIGS. 10 and 11*b*. In this modification, the doorframe supporting body 60 is directly coupled to the rotational shaft 21 of the door closer unit 100 by the use of the wedge 70, without the door supporting body 50.

More specifically, one side end of the doorframe supporting body 60 is secured to the upper end of the door D, and a bracket 90 fixed to the outer surface of the housing 10 is secured to the doorframe D1 via screws 91. The bracket 90 may be integrally formed with the housing 10.

When opening or closing such a door D, the rotational shaft 21 of the door closer unit 100 rotates within the housing 10. Thus, the door closer unit 100 rotatably supporting the door D may be mounted thereon without any hinge member.

Figure 11C:
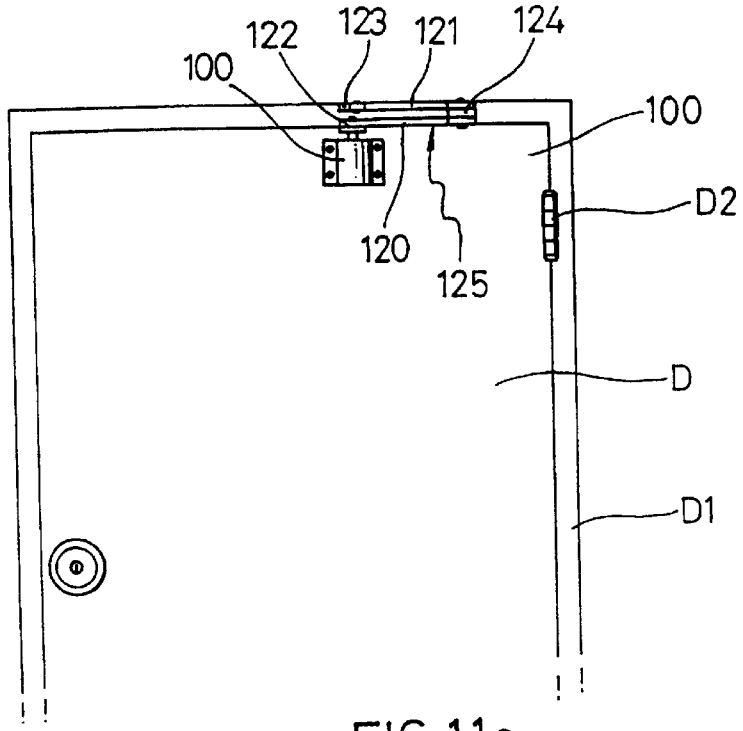
FIG. 11*c* is a front view of the inventive door closer unit provided to the door and the doorframe supporting body connected with the doorframe via a refraction link.

According to a modification of FIG. 11*c*, the door closer unit 100 is mounted on the door by the use of a pair of hinge arms 120 and 121 and three hinges 122, 123 and 124, like the conventional technique.

The door closer unit 100 is securely fixed to one side surface of the door D, and the rotational shaft 21 of the moving body 20 is connected to a refraction link 125 with one end hinged on the doorframe D1 and operating. One side of the door D is hinged on the doorframe D1 by a pair of the hinges assembly D2. When the door D rotates, the rotational shaft 21 turns within the housing 10 by the door opening angle, and the recovering force is generated to automatically close the door D.

Figure 11D:
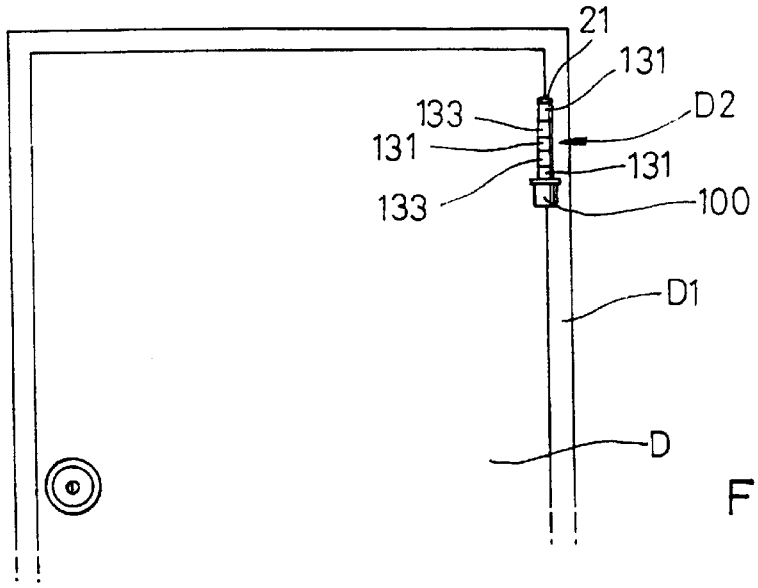
FIG. 11*d* is a front view of the inventive door closer unit provided to a hinge shaft for supporting the door.
Figure 11E:
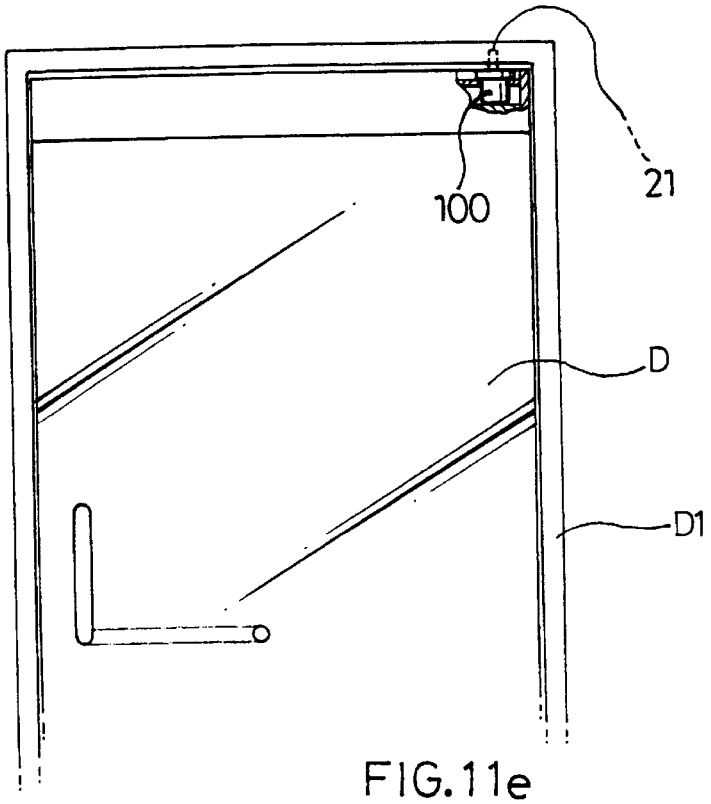
FIG. 11*e* is a front view of the inventive door closer unit embedded in the door and a rotational shaft of a moving body installed on the doorframe.
Figure 11F:
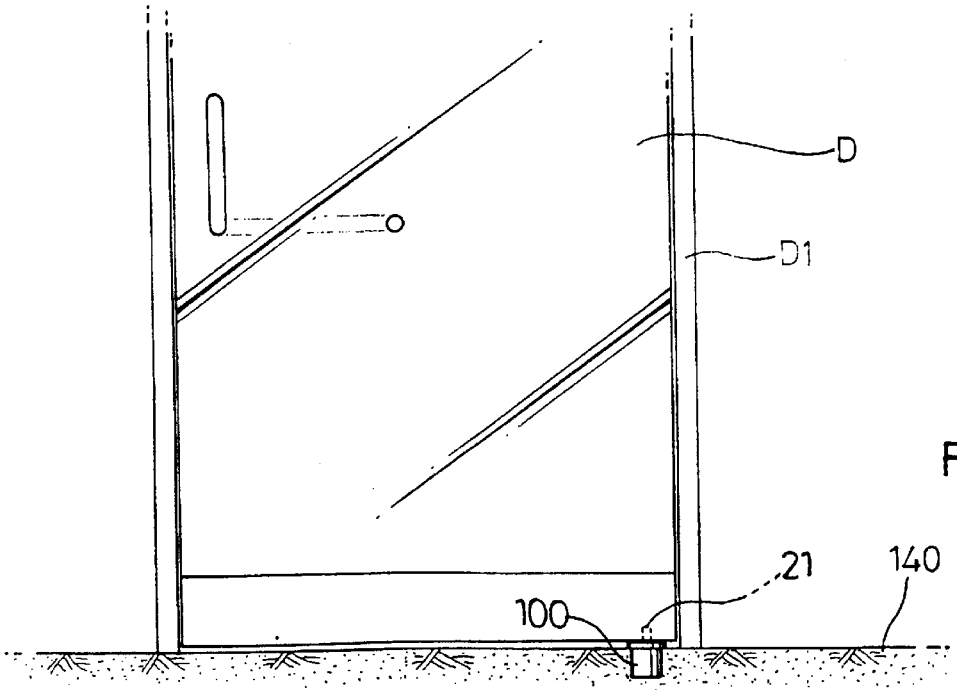
FIG. 11*f* is a front view of the inventive door closer unit embedded in a floor and the rotational shaft of the moving body mounted on the door.

As another modification shown in FIG. 11*d*, for the housing immovable & rotational shaft revolving manner, the door closer unit 100 is integrally joined to the hinge assembly D2 rotatably supporting the door's one side.

Figure 13:
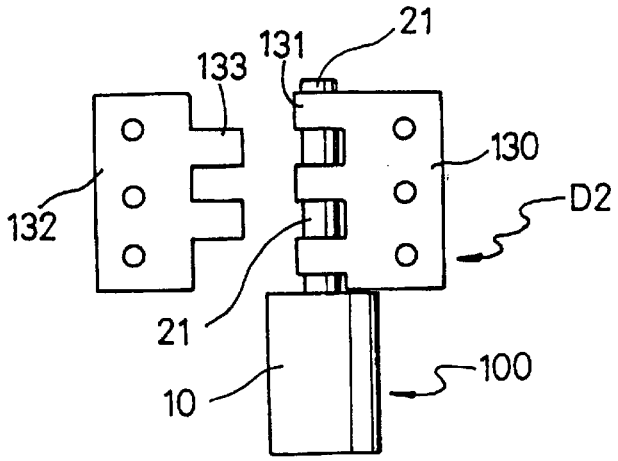
FIG. 13 is an enlarged-exploded view of a hinge integrally joined to the door closer unit of FIG. 11*d;*

As shown in FIG. 13, the upper part of the housing 10 is secured to a hinge 130's lower end screwed to the doorframe D1, and a connecting portion 131 of the hinge 130 is hinged on the rotational shaft 21. A connecting portion 133 of the other hinge 132 screwed to the door D is secured to the outer surface of the cylindrical rotational shaft 21. As the door D rotates, the rotational shaft 21 turns within the housing 10 in such a manner that the door closer unit allows the door to be closed and to stop at a given angle.

As described above, the hinge assembly D2 is integrally formed with the door closer unit 100, and the assembling work is finished just by fastening some screws, thus enhancing the working efficiency.

Figure 15A:
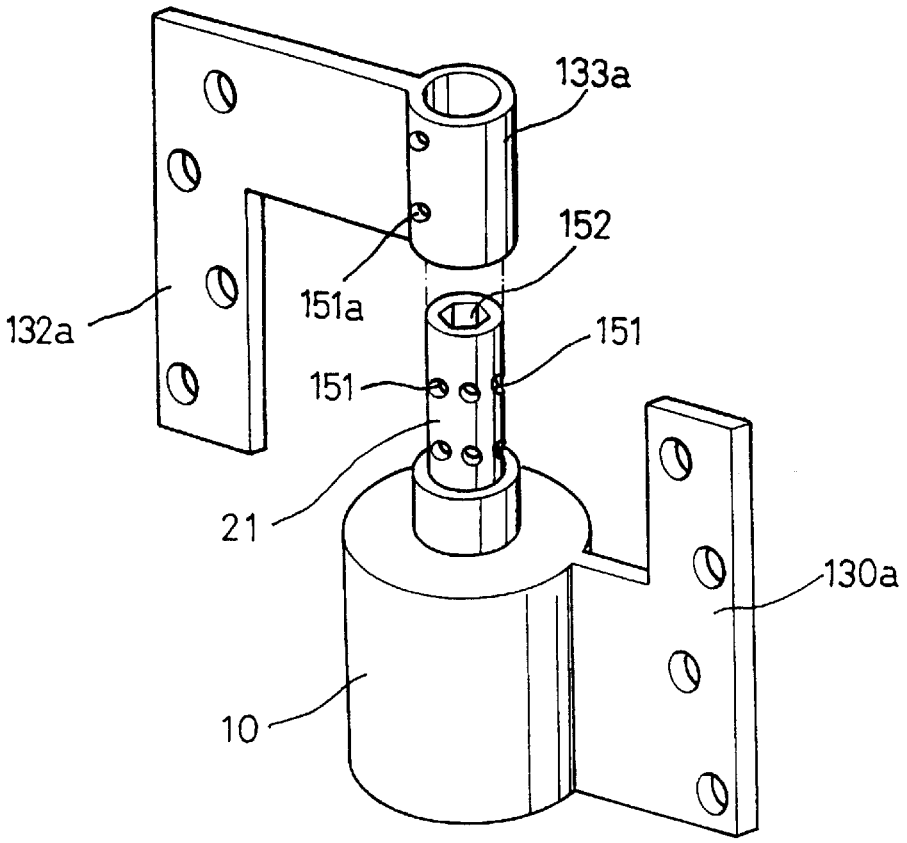
FIG. 15*a* is an enlarged-exploded view of a hinge built-in door closer unit.
Figure 15B:
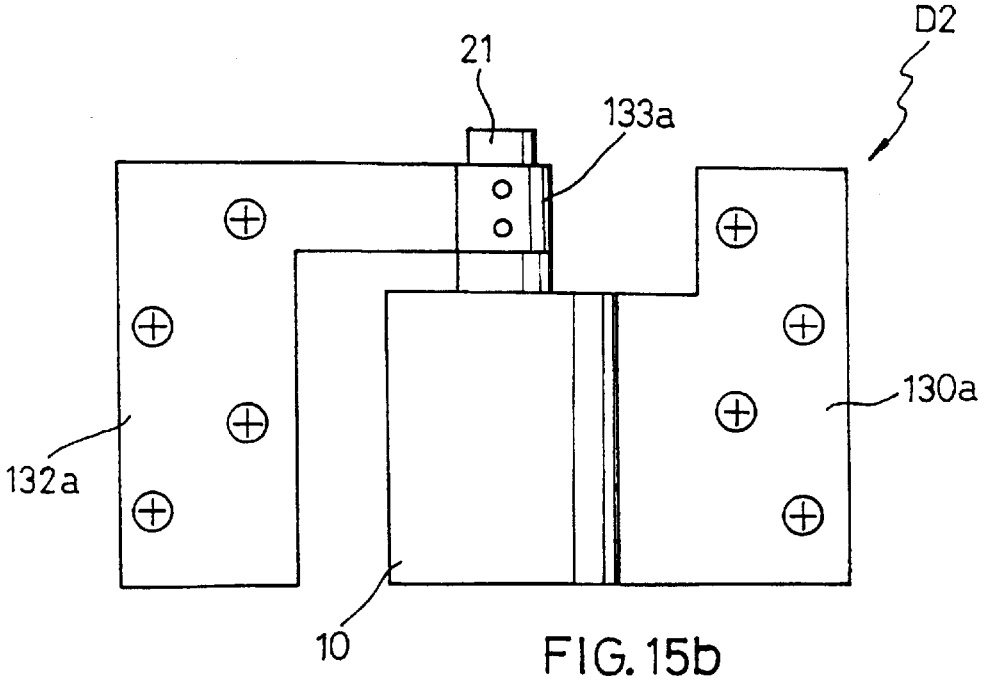
FIG. 15*b* is a front view of its assembling state.
Figure 15C:
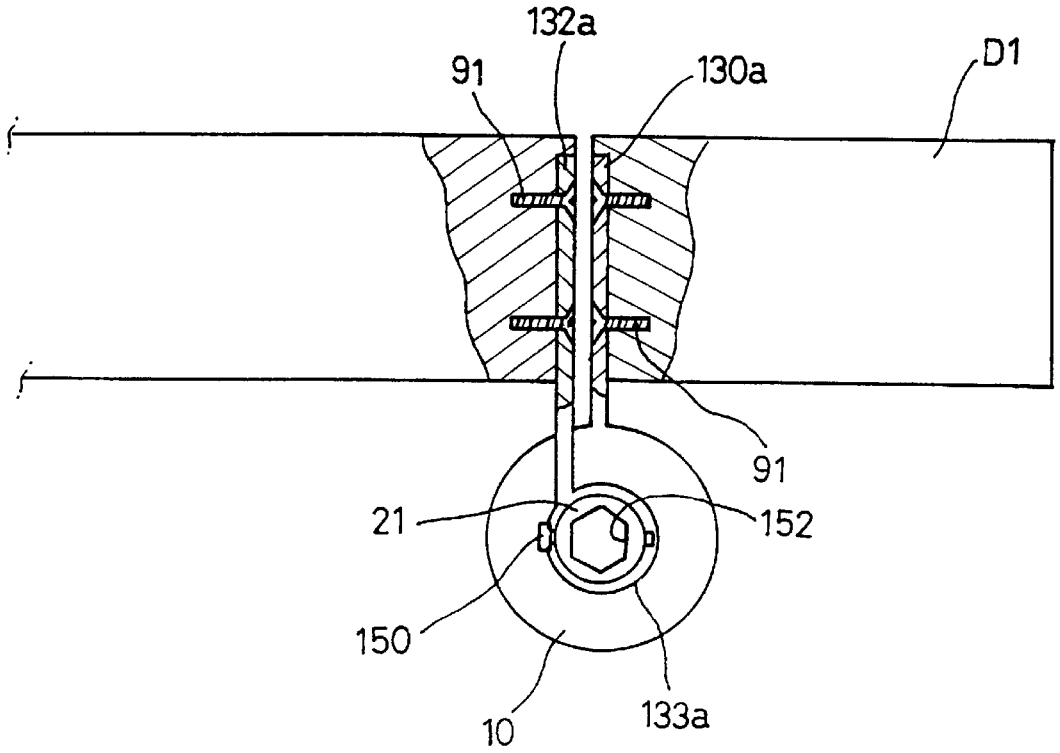
FIG. 15*c* is a plan view of the hinge built-in door loser unit of FIG. 15*b* mounted on a door and a doorframe.

FIG. 15*a* is an enlarged-exploded view of a hinge built-in door closer unit, and FIG. 15*b* is a front view of its assembling state. FIG. 15*c* is a plan view of the hinge built-in door closer unit of FIG. 15*b* mounted on a door and a doorframe.

The side surface of the housing 10 is secured to a hinge 130*a*'s side secured to the doorframe D1 by a screw 91, and a connecting portion 133*a* of the other hinge 132*a* screwed to the door D is secured to the outer surface of the cylindrical rotational shaft :21 by the use of a pin 150.

A hexagonal or rectangular hole 152 is formed on the top of the rotational shaft 21 or the rotational shaft 21 has a hexagonal or rectangular-shaped upper section. A plurality of through holes 151 are radially formed in two rows on the outer surface of the rotational shaft's upper section, passing through the core of the shaft 21. The connecting portion 133*a* of the hinge 132*a* has a plurality of through holes 151*a* radially formed passing through the core of the connecting portion 133*a*.

In the formation of the hinge assembly D2, after the connecting portion 133*a* of the hinge 132*a* is connected to the outer surface of the cylindrical rotational shaft 21 and the rotational shaft 21 is rotated in advance by the use of a hexagonal wrench or rectangular wrench to apply the residual stress, the through holes 151*a* of the connecting portion 133*a* mate with the through holes of the rotational shaft 21 by the pin 150.

As the door D rotates, the rotational shaft 21 turns within the housing 10 in such a manner that the door closer unit allows the door to be closed and to stop at a given angle. In this case, the hinge assembly D2 is integrally formed with the door closer unit 100, and the assembling work is finished just by fastening some screws into the unit 100, thus enhancing the working efficiency.

FIGS. 11*e* and 11*f* depict a modification in which the door closer unit 100A for a two-way revolving door is applied to a floor-hinge door without using the fixing assembly 200. The door closer unit 100A is embedded in one side of the door D's upper end portion, and the rotational shaft 21 of the moving body 20 is fixed onto the corresponding spot of the doorframe D1. The door closer unit 100 may be embedded in the door D's floor surface 140, and the rotational shaft 21 of the moving body 20 is directly connected to the door D's lower end to serve as a hinge shaft.

Figure 14:
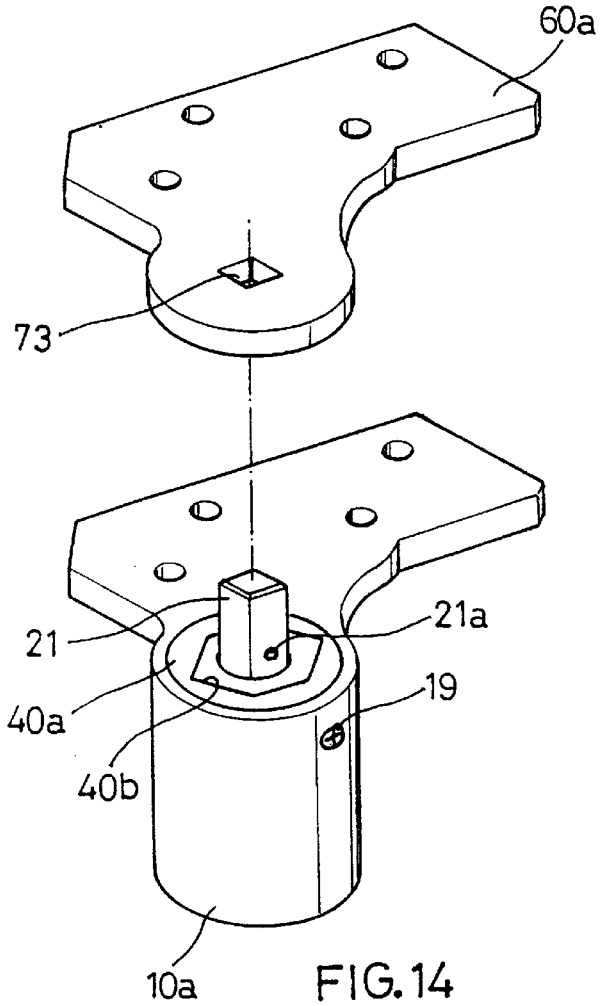
FIG. 14 is a perspective view of a door closer unit with a housing having an integrally formed hinge in accordance with a fourth preferred embodiment of the present invention.

Referring to FIG. 14, a door closer unit with a hinge built-in housing of a fourth preferred embodiment of the present invention is now described.

When comparing the fourth preferred embodiment to the first preferred embodiment illustrated in FIGS. 1 and 2, the interior of its housing is the same as that of the housing of the first preferred embodiment, and its door fixing assembly is changed very simply.

In the door closer unit of the fourth preferred embodiment, a housing 10*a* is made of aluminum by die casting and integrally formed with a door hinge assembly. The outer circumference of a cover 40*a* is joined to the housing 10*a* by screws, and an extra screw assembling process is not necessary. A threshold supporting body 60*a* is directly joined to the housing 10*a* by directly fitting its rotational shaft 21 into the square through hole 73 without using the extra wedge 70.

In FIG. 14 the following reference numerals denote the following reference parts: 40*b* a hexagonal hole used for joining the cover 40*a* to the housing 10*a* by using a hexagonal wrench; 19 a hydraulic control hole for controlling the door closing speed; and 21*a* used for rotating the rotational shaft 21 by a predetermined angle to apply the residual stress to the moving body 20.

The door closer unit of the fourth preferred embodiment, having the housing integrally formed with the door supporting body, is more simple than that of the first preferred embodiment in construction, which facilitates manufacturing and assembling works.

The inventive door closer unit is of a compact structure in which the recovering force is produced in the rotating body by the relative rotating motion of the housing and rotational shaft, and the rotating body has a very large rotation angle. The door closer unit is of low weight, simple external shape, and may be variously designed. Since the overall construction of the inventive door closer unit is simple and the number of its components is small, it is easy to assemble and install it on the door, and the number of manufacturing steps is reduced to lower the production costs, assuring a trouble-free operation. The door closer unit allows the smooth door opening and slow door closing operation, the door initial position automatic returning and stopping operation. In addition, the inventive door closer unit lets a door be fixed at a given position and released, and assures complete door closing, two-way rotation, shock absorbing, door closing speed control, etc.

Industrial Applicability

The door closer unit of the present invention is applicable to iron gates of buildings, glass or wooden doors, doors of household electric appliances such as refrigerators, and doors of furniture.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are described to be protected.

What is the claimed is:

1. A door closer unit comprising:

a cylindrical housing with a partition axially extending from one side of its inner surface and having a first liquid path and a tiered shaft receiving nest on the center of its inner bottom;

a moving body with a movable barrier having an outer surface in a sliding contact with the partition, protruding from its one side to be in sliding contact with the inner surface of the housing, and dividing the interior of the housing into first and second chambers, and a rotational shaft having a lower end rotatably housed in the shaft receiving nest and an upper end extending upward;

rotating body return means disposed between the shaft receiving nest and the moving body's inner groove, and, when one of the moving body's rotational shaft and housing is fixed to a doorframe and the other is fixed to the door and rotates in one direction, applying a recovering force to a rotating body in a direction opposite to said direction;

a high-viscosity liquid filling in the housing;

first check valve means disposed on one side of the movable barrier, opening a second liquid path allowing the first and second chambers to communicate with each other when said rotating body rotates in one direction, and closing the second liquid path when the rotating body turns in a direction opposite to said direction;

cover means rotatably supporting the rotational shaft of the moving body and sealing the upper portion of the housing; and speed control means regulating the amount of the liquid flowing from one chamber of high pressure to the other chamber of low pressure via the first liquid path of the housing when said rotating body is turned, thus controlling the speed of said rotating body;

the door being opened if said rotating body is turned in one way, and the door being closed if the rotating body is turned in the opposite direction by the recovering force from the return means, when opening the door, the liquid flowing through said first and second liquid paths whereby the rotating body is turned at high speed, and when closing the door, the liquid flowing through the first liquid path only whereby the rotating body is turned at low speed.

2. A door closer unit according to claim 1, further comprising:

a projecting pin elastically provided to one of the movable barrier's upper section, lower section or outer surface that contacts the inner circumference of the housing; and at least one stop hole disposed on a track made on a fixed body by the rotating body to stop the rotating door when the projecting pin mates with the stop hole.

3. A door closer unit according to claim 2, wherein said moving body has an initial position defined on either first and second points near both sides of the partition or a third point between the first and second points, and the stop hole is formed on said initial position.

4. A door closer unit according to claim 3, wherein at least one stop hole is formed on a door opening position.

5. A door closer unit according to claim 1, further comprising:

shock absorbing means inserted into the housing for absorbing an impact created when the movable barrier collides with the partition by an external force applied to the rotating body.

6. A door closer unit according to claim 1, wherein the first check valve means includes:

at least one liquid path for allowing the first and second chambers to communicate with each other; and a flexible valve plate formed on one side of the movable barrier opposite to the partition for shutting off said liquid path.

7. A door closer unit according to claim 1, wherein while the rotational shaft has been turned by a given angle in the same direction as the rotating direction of the rotating body in the initial position of the moving body, the rotational shaft is fixed to a doorframe supporting body, and the residual stress remains even when the opened door returns to an initially set position.

8. A door closer unit according to claim 1, further comprising:

a second check valve means disposed on the other side of the movable barrier, opening the third liquid path when the rotational shaft is turned in the opposite direction, and closing the third liquid path when the rotational shaft is turned in one direction; and initial position setting means having first and second magnets of different polarity each disposed on one side wall of the housing opposite to the partition and on a corresponding point of the movable barrier of the moving body;

said door being a two-way revolving door.

9. A door closer unit according to claim 8, wherein the housing of the door closer unit is fixedly embedded in a floor, and the rotational shaft constitutes a lower hinge shaft of the door.

10. A door closer unit according to claim 8, wherein the housing of the door closer unit is fixedly embedded in the door's upper end, and the rotational shaft constitutes an upper hinge shaft of the door.

11. A door closer unit according to claim 1, wherein the housing is fixedly disposed on the doorframe's uppermost portion, and the rotational shaft is disposed on the upper end of the door through the door supporting body, thus constituting a hinge shaft of the door.

12. A door closer unit according to claim 1, further comprising:

a door supporting body having one end secured to the cover means and the other end fixedly disposed on the upper end of the door; and a doorframe supporting body having one end secured to the rotational shaft of the moving body and the other end fixedly disposed on a point corresponding to the door supporting body of the doorframe, said door closer unit used as an upper hinge.

13. A door closer unit according to claim 1, further comprising:

a bracket for securing the housing to the upper end of the door; and a first hinge arm having one end hinged upon the rotational shaft, a second hinge arm having one end joined to the other and of the first hinge arm via a hinge assembly, and the other end hinged upon the upper end of the doorframe.

14. A door closer unit according to claim 1, wherein the upper end of the housing is integrally formed with a lower end portion of a doorframe fixing plate of a hinge assembly by which the door is joined to the doorframe, and the rotational shaft is fixed to a connecting portion extending from a door fixing plate of the hinge assembly.

15. A door closer unit comprising:

a cylindrical housing with a partition axially extending from one side of its inner surface and having a first liquid path and a tiered shaft receiving nest on the center of its inner bottom;

a moving body with a movable barrier having an outer surface in sliding contact with the partition, protruding from its one side to be in sliding contact with the inner surface of the housing, and dividing the interior of the housing into first and second chambers, and a rotational shaft having a lower end rotatably housed in the shaft receiving nest and an upper end extending upward;

door return means disposed between the shaft receiving nest and the moving body's inner groove, and, when one of the moving body's rotational shaft and housing is fixed to a doorframe and the other is fixed to the door and rotates in one direction, applying a recovering force to the door in a direction opposite to said direction;

a high-viscosity liquid filling in the housing;

control check valve means disposed on one side of the movable barrier, opening a second liquid path allowing the first and second chambers to communicate with each other when said door is opened, and closing the second liquid path when the door is closed;

cover means rotatably supporting the rotational shaft of the moving body and sealing the upper portion of the housing; and speed control means regulating the amount of the liquid flowing from one chamber of high pressure to the other chamber of low pressure via the first liquid path of the housing when the door is opened or closed, thus controlling the speed of said door; and door stop means for stopping the door when the door reaches to a predetermined rotating angle including the door's initial position;

the door being automatically closed by the recovering force of the door return means as the door is opened, the liquid flowing through the first and second liquid paths at high speed if the door is opened, and the liquid flowing through the first liquid path only at low speed if the door is closed.

16. A door closer unit according to claim 15, wherein said control valve means is a two-way check valve, and the door closer unit is used as a hinge assembly of a two-way revolving door.

17. A door closer unit according to claim 15, wherein said door closer unit is mounted on the door and the doorframe in one of a housing immovable & rotational shaft revolving manner and a rotational shaft immovable & housing revolving manner.

18. A door closer unit according to claim 15, wherein said door return means is one of a coil spring, a plate spring, or a torsion bar.

* * * * *